US005394923A

United States Patent [19]

Danziger

[11] Patent Number: 5,394,923

[45] Date of Patent: Mar. 7, 1995

[54] RESILIENT BARRIER GATE

[76] Inventor: Jordan Danziger, 5 Amberson Ave., Yonkers, N.Y. 10705

[21] Appl. No.: 63,220

[22] Filed: May 17, 1993

[51] Int. Cl.[6] ..... E05F 15/00

[52] U.S. Cl. ..... 160/188; 160/201

[58] Field of Search ..... 160/188, 189, 201, 208, 160/135, 351

[56] References Cited

U.S. PATENT DOCUMENTS

| | | | |
|---|---|---|---|
| 1,916,651 | 7/1933 | Beeman et al. | 160/189 |
| 3,875,711 | 4/1975 | Palmer | 160/135 X |
| 4,085,789 | 4/1978 | Steiner et al. | 160/135 |
| 4,134,439 | 1/1979 | Scott | 160/135 |
| 4,538,661 | 9/1985 | Henry et al. | 160/189 X |
| 4,774,792 | 10/1988 | Ballance | 160/135 X |
| 4,811,777 | 3/1989 | Chretien | 160/189 X |
| 4,842,035 | 6/1989 | Thompson | 160/135 |
| 5,070,665 | 12/1991 | Marrin et al. | 160/351 X |
| 5,205,070 | 4/1993 | Lundstrom | 160/189 X |

*Primary Examiner*—David M. Purol

*Attorney, Agent, or Firm*—Scully, Scott, Murphy & Presser

[57] ABSTRACT

A barrier gate for preventing access to a restricted area which is designed to be lightweight and yet sufficiently resilient to return to its original shape after being impacted by heavy equipment. The barrier gate outer frame includes a plurality of flexible plastic tubular frame members which are joined together by frame joint couplers, including one at each corner of the frame. One or more inner flexible plastic tubular frame members extend across the outer frame and are joined thereto by frame joint couplers. A flexible plastic web material is supported in each field between the outer and inner frame members. In a preferred embodiment, all of the outer and inner frame members, and all of the frame joint couplers are formed of PVC plastic. In a preferred embodiment, the barrier gate outer frame is rectangular in shape, and includes two upper horizontal flexible tubular frame members joined by a T frame joint coupler, and similarly two lower horizontal flexible tubular frame members joined by a T frame joint coupler. The frame further includes two left vertical flexible tubular frame members joined by a T frame joint coupler, and similarly two right vertical flexible tubular frame members joined by a T frame joint coupler. The inner frame includes two horizontal and two vertical inner flexible plastic tubular frame members, all of which are joined in the center of the frame by a central X frame joint coupler.

12 Claims, 3 Drawing Sheets

RESILIENT BARRIER GATE

BACKGROUND OF THE INVENTION

1. Field of the Invention

The present invention relates generally to a barrier gate or door to prevent access to a restricted or dangerous area such as an elevator or hoistway shaft, particularly for commercial applications wherein the barrier gate or door is frequently damaged by contact with heavy operating equipment or vehicles. More particularly, the subject invention pertains to a barrier gate or door as described which is constructed with a resilient and flexible structure such that it is not easily damaged by impacts by heavy operating equipment or vehicles.

2. Discussion of the Prior Art

Vehicular garages, warehouses, and other material handling facilities frequently utilize elevators in their operations. The elevators are typically constructed with safety doors or barrier gates which are closed except when loading or unloading the elevator to provide for the safety of the workers. One problem with this arrangement is that the material being handled, the loading equipment, or vehicles sometimes accidentally contact and damage the doors and/or the door operating mechanisms rendering the elevator useless with a consequential adverse impact on the entire commercial operation.

As a result of this incapacitation and the extreme urgency of continuity of commercial operations, safety circuits are frequently bypassed in one manner or another and the elevator is operated with the barrier doors open, producing an extremely hazardous condition.

Conventional barrier doors or gates are constructed of and are mounted on and guided by rigid structural materials which often become permanently bent, ruptured, or destroyed at the time of impact. Through the years, these structures have been designed to be stronger and more rigid, and as a consequence thereof, if the door or its mountings does not deform under the impact, the entire wall sometimes caves in.

SUMMARY OF THE INVENTION

Accordingly, it is a primary object of the present invention to provide a resilient barrier gate or door which is sufficiently rigid to satisfy safety requirements, while the barrier gate, its components and operating mechanisms are sufficiently flexible to withstand normal impacts and collisions frequently encountered during their normal operation.

When designing barrier doors or gates for such commercial elevators, the weight of the components is of primary importance while also considering the parameters of safety and capacity. The barrier gate of the subject invention weighs less than one-tenth the weight of conventional equipment. The frame is constructed of flexible plastic tubes and fittings of a material such as polyvinyl chloride (PVC) which is capable of being bent at a 45° angle and still returning to an original configuration.

The field of the barrier gate supported between the frame members is preferably made of a heavy duty high polymer mesh material, such as construction safety netting, and can be integrally colored a "safety orange."

The guides for the barrier gate are preferably steel cables under spring or counterweight tension which return to their original positions after being distorted under impact.

In embodiments of the present invention designed for automatic power operation, the driving mechanism is mounted overhead, clear of any anticipated impact. Because of the extremely lightweight construction of a resilient barrier gate pursuant to the present invention, only a single speed driving mechanism is required, as opposed to two speed operation required by conventional equipment, and moreover the power requirements are extremely low.

A resilient barrier gate pursuant to the present invention may be operated either vertically, horizontally or radially, and can be operated manually or powered automatically. The barrier gate can be provided with a support linkage to rise vertically and pivot to a horizontal position close to the ceiling or overhead structure. It may also be guided by rigid tracks mounted sufficiently high to be clear of any anticipated impact. A system of electromechanical interlocks and limits may be utilized for the purposes of safety.

A resilient barrier gate pursuant to the present invention will, if distorted, return to its original shape and mechanical condition and continue to function normally, providing for maximum safety and continuity of operations.

In accordance with the teachings herein, the present invention provides a barrier gate for preventing access to a restricted area, and is designed to be lightweight and yet sufficiently resilient to return to its original shape after being impacted by heavy equipment. The barrier gate outer frame includes a plurality of flexible plastic tubular frame members which are joined together by frame joint couplers, including one at each corner of the frame. One or more inner flexible plastic tubular frame members extend across the outer frame and are joined thereto by frame joint couplers. A flexible plastic web material is supported between the outer and inner frame members. In a preferred embodiment, all of the outer and inner frame members, and all of the frame joint couplers are formed of PVC plastic.

In a preferred embodiment, the barrier gate outer frame is rectangular in shape, and the barrier gate frame includes two upper horizontal flexible tubular frame members joined by a T frame joint coupler, and similarly two lower horizontal flexible tubular frame members joined by a T frame joint coupler. The frame further includes two left vertical flexible tubular frame members joined by a T frame joint coupler, and similarly two right vertical flexible tubular frame members joined by a T frame joint coupler. The inner frame includes two horizontal and two vertical inner flexible plastic tubular frame members, all of which are joined in the center of the frame by a central X frame joint coupler.

Each bottom corner frame joint coupler preferably comprises an X frame joint coupler, wherein first and second legs of the coupler are secured respectively to a horizontal and a vertical outer frame member, a third leg of the coupler is capped and rests on the floor beneath the barrier gate, and a fourth leg of the coupler is secured to a cable which supports the barrier gate for vertical movements.

In one preferred embodiment, the barrier gate is supported for vertical movement by left and right flexible cables which are secured to the frame joint coupler at the lower corners of the barrier gate. Each of the flexible cables extends around a pulley secured to a floor beneath the barrier gate, and is driven by a motor mounted to a ceiling above the barrier gate, such that the motor is mounted at an elevated position to be out of the way of heavy equipment. Each flexible cable is secured to its respective frame joint coupler by a T coupler, with the top T member thereof encircling the cable and the bottom T member thereof being coupled to its respective frame joint coupler. The top T member of each T coupler can be packed with a fiber gib. The frame joint coupler at the upper left and right corners of the barrier gate mount guide roller wheels which move in left and right guide tracks. The guide tracks are secured to the ceiling above the barrier gate and extend downwardly therefrom only to the upper corners of the barrier gate, such that the guide tracks are also mounted in elevated positions to be out of the way of heavy equipment.

BRIEF DESCRIPTION OF THE DRAWINGS

The foregoing objects and advantages of the present invention for a resilient barrier gate may be more readily understood by one skilled in the art with reference being had to the following detailed description of several preferred embodiments thereof, taken in conjunction with the accompanying drawings wherein like elements are designated by identical reference numerals throughout the several views, and in which.

DETAILED DESCRIPTION OF THE DRAWINGS

Figure 1:
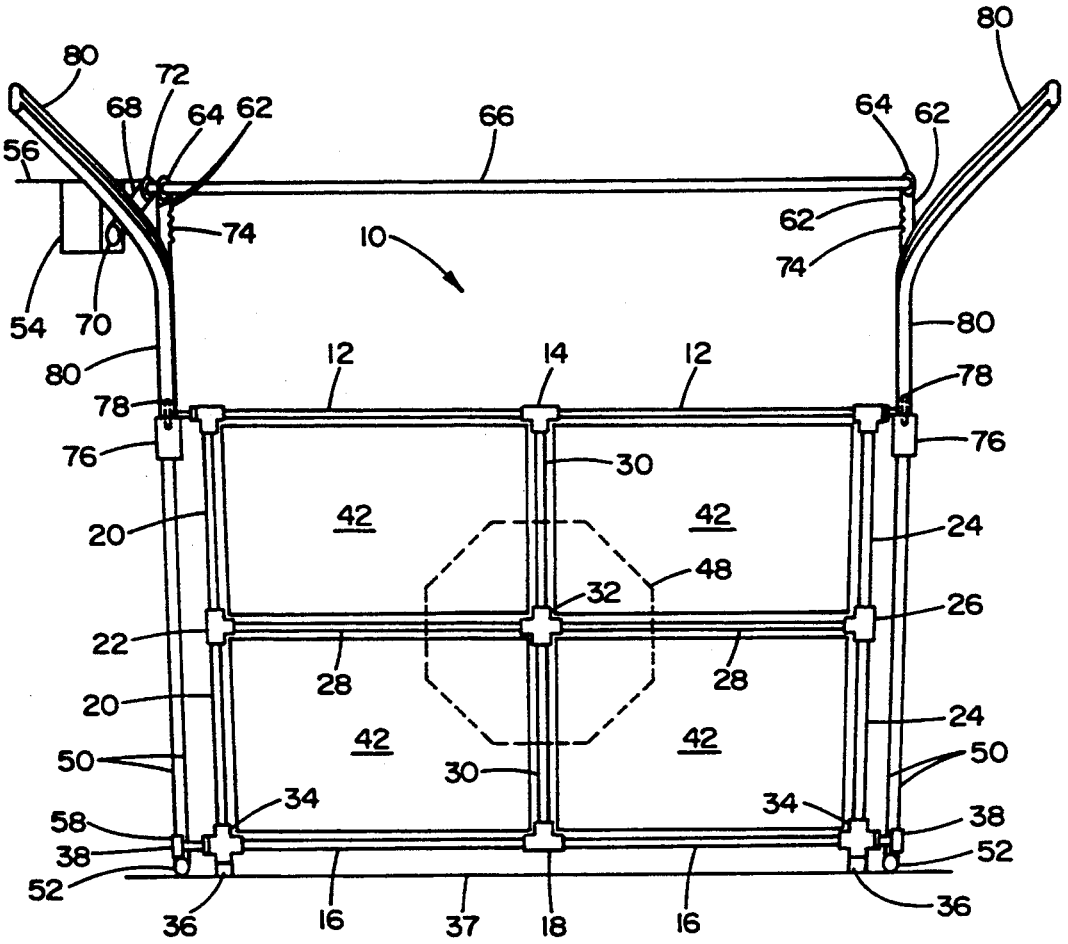
FIG. 1 is a front elevational view of a first exemplary embodiment of a resilient barrier gate constructed pursuant to the teachings of the present invention.

Referring to the drawings in detail, FIG. 1 is a front elevational view of a first exemplary embodiment of a resilient barrier gate 10 constructed pursuant to the teachings of the present invention. The resilient barrier gate 10 is designed to be sufficiently rigid to satisfy safety requirements, while the barrier gate, its components and operational mechanisms are sufficiently flexible to withstand normal impacts and collisions frequently encountered during their normal operation. In FIG. 1, the resilient barrier gate is positioned in front of an elevator or hoistway shaft to prevent access thereto to provide for the safety of workers, and is provided with electromechanical interlocks which prevent the gate from being raised except when an elevator is properly positioned behind the barrier gate.

In the embodiment of FIG. 1, the barrier gate outer frame is rectangular in shape, and includes two upper horizontal flexible tubular frame members 12 joined by a T frame joint coupler 14, and similarly two lower horizontal flexible tubular frame members 16 joined by a T frame joint coupler 18. The frame further includes two left vertical flexible tubular frame members 20 joined by a T frame joint coupler 22, and similarly two right vertical flexible tubular frame members 24 joined by a T frame joint coupler 26. The inner frame includes two horizontal tubular frame members 28 connected at their outer ends to respectively the T couplers 22 and 26, and two vertical inner flexible plastic tubular frame members 30 connected at their outer ends to respectively the T couplers 14 and 18, all of which are joined in the center of the frame by a central X frame joint coupler 32.

Each bottom corner frame joint coupler 34 preferably comprises an X frame joint coupler, wherein first and second legs of the coupler are secured respectively to a horizontal outer frame member 16 and a vertical outer frame member 20 or 24. A third leg of the coupler 34 is capped at 36 and rests on the floor 37 beneath the barrier gate, and a fourth leg of the coupler is secured by a T coupler or guide shoe 38 to a cable 40 which supports the barrier gate for vertical movements.

In the field of the barrier gate, a flexible plastic web material 42 is supported in each of four quadrant panels of the barrier gate defined between the outer and inner frame members. The flexible plastic web material is preferably made of a heavy duty, high density polymer mesh material, such as construction safety netting, and can be integrally colored a "safety orange." As illustrated in greater detail in FIG. 2, each field panel 42 can be constructed with an outer frame consisting of four frame members 44, one securely attached to each side edge of the mesh material, and the mesh frame members 44 are then secured to the gate frame members by a plurality of plastic ties 46 such as heavy nylon ties. A traditional STOP sign 48, shown in phantom in FIG. 1, can be secured to the central gate frame members to emphasize that the gate is positioned in front of a restricted and dangerous area. In a preferred embodiment, all of the outer and inner frame members, and all of the frame joint couplers are formed of a high strength and resilient plastic material such as polyvinyl chloride (PVC) plastic to provide an extremely lightweight and flexible structure.

In the illustrated embodiment, the barrier gate is supported for vertical movements by left and right flexible cables 50 which are secured to the frame joint coupler by the T coupler or guide shoe 38 at the lower corners of the barrier gate. Each of the flexible cables 50 extends around a pulley 52 secured to the floor 37 beneath the barrier gate, and is driven by a motor 54 mounted to an overhead structure such as a ceiling 56 above the barrier gate, such that the motor is mounted at an elevated position to be out of the way of heavy equipment. Each flexible cable 50 is secured to its respective frame joint coupler by the T coupler or guide shoe 38, with the top T member 58 thereof encircling and being fastened to the cable and the bottom T member 60 thereof being coupled to its respective frame joint coupler. Each cable 50 is mounted in series with a drive chain 62 in an endless loop, with the cable encircling the bottom pulley 52 and the drive chain 62 encircling a top drive sprocket 64, with both top drive sprockets 64 being mounted on a common drive shaft 66 also mounted to the overhead structure or ceiling. The motor 54 is coupled to the drive shaft 66 by a drive mechanism which can include an endless loop drive chain 68 extending from a drive sprocket 70 at the motor 54 to a drive sprocket 72 on the drive shaft 66. As stated hereinabove, each cable 50 is connected in an endless loop with a drive chain 62 which extends around the drive sprocket 64 connected to the drive shaft 66. A spring 74 can be included in each drive cable/drive chain endless loop to provide a resilient drive coupling for the endless drive loop. The frame joint coupler 76 at the upper left and right corners of the barrier gate mount guide roller wheels 78, shown in phantom in FIG. 1, which move in left and right guide tracks 80. The guide tracks 80 are also secured to the overhead structure or ceiling 56 above the barrier gate and extend downwardly therefrom only to the upper corners of the barrier gate, such that the guide tracks 80 are also mounted in elevated positions to be out of the way of heavy equipment.

Figure 2:
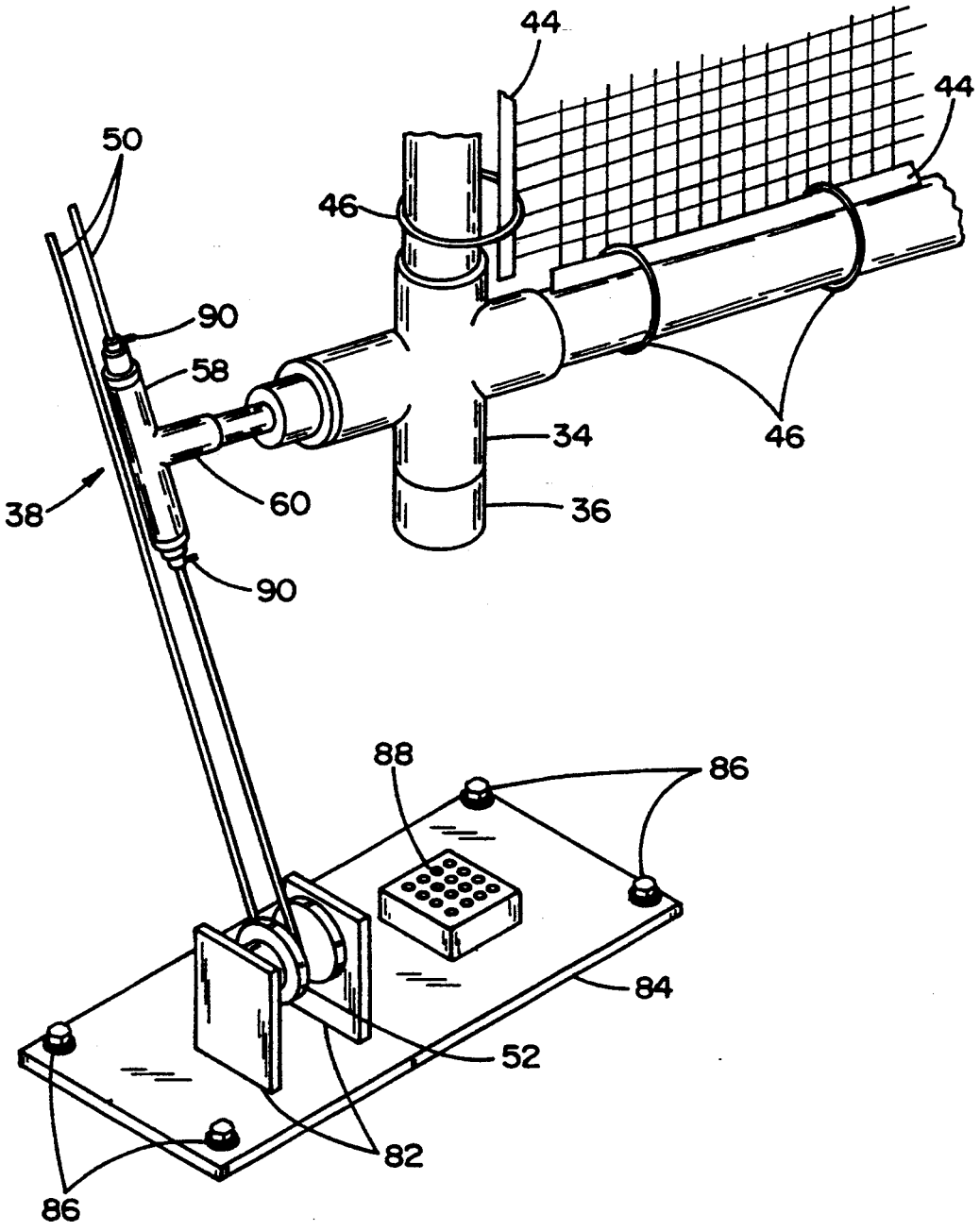
FIG. 2 illustrates the left front corner of the resilient barrier gate of FIG. 1, and shows the cable drive system and cooperating structure mounted to the floor.

FIG. 2 illustrates the left front corner of the resilient barrier gate of FIG. 1, and shows the cable drive system and cooperating structure mounted to the floor. The pulley 52 is mounted in a pulley frame 82 which is mounted on a floor mounted plate 84 which is bolted at 86 to the floor. A small post 88 is also mounted on the floor mounted plate 84 to be positioned beneath the end cap 36 of the corner frame joint coupler 34 such that the cap 36 rests on the post 80 when the barrier gate is in a lowered position. In addition to a direct fastening of the T coupler or guide shoe 38 to the cable 50, cable clamps 90 can be mounted above and below each guide shoe 38 to further secure that structure to the cable 50.

Figure 3:
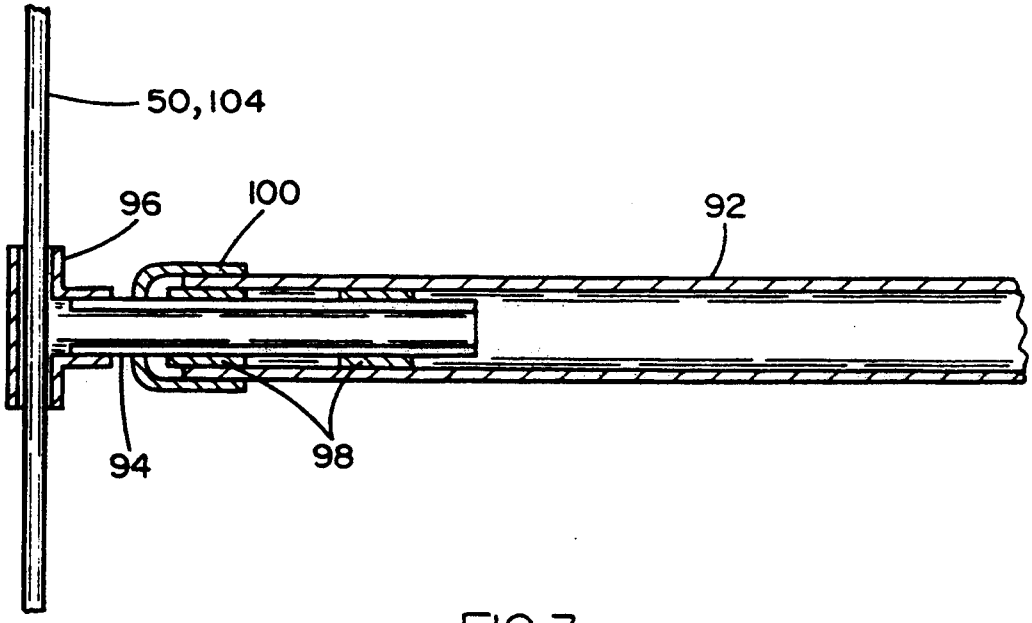
FIG. 3 illustrates a sectional view of a guide shoe for securing the resilient barrier gate to a support or drive cable.

FIG. 3 illustrates a sectional view of a second embodiment of a T coupler or guide shoe 38 for securing the resilient barrier gate to a support or drive cable 50. A short length of PVC pipe or tube 92 extends from the third leg of the bottom corner coupler 34 to which it is secured, and a further short length of a PVC pipe or tube 94 extends from inside the bottom leg of a T fitting 96 into the pipe 92 and is supported therein by two PVC bushings 98. An end cap 100 closes the end of the PVC pipe 92, with the PVC pipe 94 extending from the bottom leg of the T fitting extending therethrough. The top T member of T fitting 96 can be lined with a fiber gib to provide a secure attachment to the cable 50.

Figure 4:
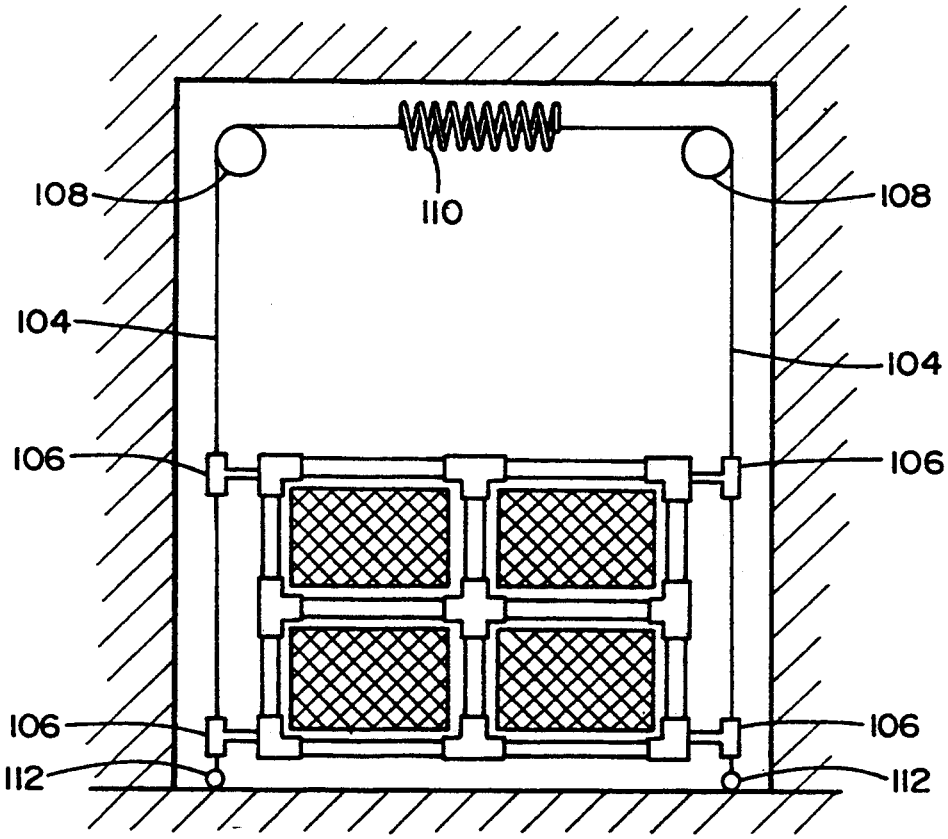
FIG. 4 is a schematic illustration of a second exemplary embodiment of a manually operated resilient barrier gate pursuant to the teachings of the present invention.

FIG. 4 is a schematic illustration of a second exemplary embodiment of a resilient barrier gate pursuant to the teachings of the present invention. The barrier gate of FIG. 4 is similar in construction to the barrier gate of FIG. 1, but is manually operable between a closed lower position and an open upper position. In this embodiment, a support cable 104 extends between guide shoes 106, which can have the construction illustrated in FIG. 3, mounted to the upper and lower corner frame joint couplers and extends upwardly therefrom to a ceiling mounted pulley 108. A spring 110, or alternatively a counterweight, is attached to the upper end of the cable 104 to counterbalance the weight of the barrier gate. In different embodiments, the support cable 104 can be a single cable extending downwardly only to the bottom corner frame joint coupler, or could be a double length of cable extending around a pulley 112 mounted to the floor and then extending upwardly therefrom in a loop similar to that illustrated in FIG. 1.

While several embodiments and variations of the present invention for a resilient barrier gate are described in detail herein, it should be apparent that the disclosure and teachings of the present invention will suggest many alternative designs to those skilled in the art.

What is claimed is:

1. A barrier gate for preventing access to a restricted area and being designed to be lightweight and resilient to return to its original shape after being impacted by heavy equipment, comprising:

a. a rectangular barrier gate frame comprising a plurality of outer flexible plastic tubular frame members extending along the outer perimeter of the rectangular barrier gate frame and including at least one upper horizontal flexible plastic tubular frame member, at lease one lower horizontal flexible plastic tubular frame member, at least one left vertical flexible plastic tubular frame member, and at least one right vertical flexible plastic tubular frame member, said outer flexible plastic tubular frame members being joined by a plurality of frame joint couplers, one at each corner of the rectangular barrier gate frame, at least one inner horizontal flexible plastic tubular frame member extending across the barrier gate frame and being joined to the outer frame members by a frame joint coupler at each end of the inner horizontal flexible plastic tubular frame member, at least one inner vertical flexible plastic tubular frame member extending across the barrier gate frame and being joined to the outer frame members by a frame joint coupler at each end of the inner vertical flexible plastic tubular frame member, and the at least one inner horizontal flexible plastic tubular frame member being joined to the at least one inner vertical flexible plastic tubular frame member by a frame joint coupler, and wherein the at least one inner horizontal flexible plastic tubular frame member and the at least one inner vertical flexible plastic tubular frame member divide the barrier gate into at least four individual areas; and b. each of said at least four individual areas being provided with a flexible plastic web material supported between the outer frame members and the inner frame members of that individual area.

2. A barrier gate for preventing access to a restricted area as claimed in claim 1, wherein each outer flexible plastic tubular frame member, each inner flexible plastic tubular frame member, and each frame joint coupler is formed of PVC plastic.

3. A barrier gate for preventing access to a restricted area as claimed in claim 1, wherein the barrier gate frame defines a horizontal center and a vertical center, and includes two said upper horizontal flexible plastic tubular frame members, joined in the horizontal center of the frame by a T frame joint coupler, and two said lower horizontal flexible plastic tubular frame members, joined in the horizontal center of the frame by a T frame joint coupler, and two said left vertical flexible plastic tubular frame members, joined in the vertical center of the frame by a T frame joint coupler, and two said right vertical flexible plastic tubular frame members, joined in the vertical center of the frame by a T frame joint coupler, two said inner horizontal flexible plastic tubular frame members joined in the horizontal and vertical center of the frame by a central X frame joint coupler, and two said inner vertical flexible plastic tubular frame members joined in the horizontal and vertical center of the frame by said central X frame joint coupler.

4. A barrier gate for preventing access to a restricted area as claimed in claim 3, wherein each outer flexible plastic tubular frame member, each inner flexible tubular plastic frame member, and each frame joint coupler is formed of PVC plastic.

5. A barrier gate for preventing access to a restricted area as claimed in claim 1, wherein said plurality of frame joint couplers, one at each corner of the rectangular barrier gate frame, comprises two bottom corner frame joint couplers, each of which comprises an X frame joint coupler having first, second, third and fourth legs, wherein the first and second legs of the X frame joint coupler are secured respectively to a horizontal and a vertical outer flexible plastic tubular frame member, a floor is positioned beneath the barrier gate, and the third leg of the X frame joint coupler is capped and can rest on the floor, and a cable which supports the barrier gate for vertical movements is secured to the fourth leg of the X frame joint coupler.

6. A barrier gate for preventing access to a restricted area as claimed in claim 1, wherein left and right flexible cables support the barrier gate for vertical movement, from a lowered position in which it prevents access to a restricted area to a raised position in which it allows access to the restricted area, with the left flexible cable being secured to a frame joint coupler at a lower left corner of the barrier gate and the right flexible cable being secured to a frame joint coupler at a lower right corner of the barrier gate.

7. A barrier gate for preventing access to a restricted area as claimed in claim 6, wherein a floor is positioned beneath the barrier gate, left and right pulleys are secured to the floor, and the left and right flexible cables extend around respectively the left and right pulleys.

8. A barrier gate for preventing access to a restricted area as claimed in claim 7, wherein a ceiling is positioned above the barrier gate, and a motor is mounted to the ceiling, such that the motor is mounted at an elevated position to be out of the way of heavy equipment, and each of the left and right flexible cables is driven by the motor.

9. A barrier gate for preventing access to a restricted area as claimed in claim 6, wherein a T coupler having a top T member and a bottom T member secures each flexible cable to its respective frame joint coupler, with the top T member encircling the cable and the bottom T member being coupled to a frame joint coupler.

10. A barrier gate for preventing access to a restricted area as claimed in claim 9, wherein the top T member of each T coupler is packed with a fiber gib.

11. A barrier gate for preventing access to a restricted area as claimed in claim 9, wherein a left guide roller wheel, which moves in a left guide track, is mounted on a frame joint coupler at an upper left corner of the barrier gate, and a right guide roller wheel, which moves in a right guide track, is mounted on a frame joint coupler at an upper right corner of the barrier gate.

12. A barrier gate for preventing access to a restricted area as claimed in claim 11, wherein a ceiling is positioned above the barrier gate, and each of said left and right guide tracks is secured to the ceiling and extends downwardly from the ceiling only to, respectively, frame joint couplers at upper left and upper right corners of the barrier gate, such that the left and right guide tracks are mounted in elevated positions to be out of the way of heavy equipment.

* * * * *